US010940348B2

(12) United States Patent
Oldham et al.

(10) Patent No.: US 10,940,348 B2
(45) Date of Patent: Mar. 9, 2021

(54) PUSH ON/PULL OFF PROTECTIVE CAP FOR FIRE PROTECTION SPRINKLERS

(71) Applicants: The Viking Corporation, Hastings, MI (US); Minimax GmbH & Co. KG, Bad Oldesloe (DE)

(72) Inventors: Michael J. Oldham, Kalamazoo, MI (US); Stefan Schnell, Stockelsdorf (DE); Shawn G. Orr, Grand Rapids, MI (US); Frank Rönnfeldt, Travenbrück (DE)

(73) Assignees: The Viking Corporation, Hastings, MI (US); Minimax GmbH & Co. KG, Bad Oldesloe (DE)

( * ) Notice: Subject to any disclaimer, the term of this patent is extended or adjusted under 35 U.S.C. 154(b) by 0 days.

(21) Appl. No.: 15/486,413

(22) Filed: Apr. 13, 2017

(65) Prior Publication Data

US 2017/0326393 A1 Nov. 16, 2017

Related U.S. Application Data

(60) Provisional application No. 62/334,186, filed on May 10, 2016.

(51) Int. Cl.
*A62C 35/68* (2006.01)
*A62C 37/08* (2006.01)
(Continued)

(52) U.S. Cl.
CPC ..... *A62C 35/68* (2013.01); *A62C 37/08* (2013.01); *A62C 37/12* (2013.01); *B05B 1/265* (2013.01); *B05B 15/16* (2018.02)

(58) Field of Classification Search
CPC ..... A62C 35/68; A62C 37/08; A62C 35/12; A62C 35/58; B05B 15/16; B05B 1/265
(Continued)

(56) References Cited

U.S. PATENT DOCUMENTS 3,388,747 A * 6/1968 Hodnett ..... A62C 37/08 169/39
3,801,014 A * 4/1974 Cantales ..... B05B 15/16 239/104
(Continued)

FOREIGN PATENT DOCUMENTS

KR 20100002350 1/2010
KR 20100002350 A * 1/2010 ..... A62C 35/58
(Continued)

OTHER PUBLICATIONS

International Searching Authority, International Search Report in International Appln. No. PCT/US2017/030747, dated Aug. 7, 2017, 2 pages.
(Continued)

*Primary Examiner* — Joseph A Greenlund
(74) *Attorney, Agent, or Firm* — Perkins Coie LLP

(57) ABSTRACT

A protective cover for a fire protection sprinkler includes a pair of sidewalls and an orthogonal wall structure connected to an upper edge of each of the pair of sidewalls. The orthogonal wall structure including a slot therein that opens along an edge of the orthogonal wall structure in alignment with an opening between the pair of sidewalls. The slot including a pair of side edges including a pair of opposing arcuate regions adapted to engage a deflector mounting boss of a fire protection sprinkler. An arcuate sidewall extends from the orthogonal wall structure and an upper wall extending inward from an upper edge of the arcuate sidewall and opposing the orthogonal wall structure to define a cavity that is adapted for receiving a deflector of a fire protection sprinkler.

16 Claims, 10 Drawing Sheets

(51) Int. Cl.
*B05B 15/16* (2018.01)
*B05B 1/26* (2006.01)
*A62C 37/12* (2006.01)

(58) Field of Classification Search
USPC ..... 169/51, 37
See application file for complete search history.

(56) References Cited

U.S. PATENT DOCUMENTS 4,066,129 A * 1/1978 Anderson ..... A62C 37/10 169/37
4,085,633 A * 4/1978 Jackson ..... B25B 13/48 81/111
4,176,756 A * 12/1979 Gellman ..... B65D 51/002 215/274
5,097,906 A * 3/1992 Polan ..... A62C 37/08 169/37
D359,340 S * 6/1995 Morgan ..... D23/213
5,447,338 A * 9/1995 Kikuchi ..... F16L 5/02 137/359
5,632,339 A 5/1997 Fenske et al.
D428,326 S * 7/2000 Nakamura ..... D8/356
6,112,821 A * 9/2000 Yokoi ..... A62C 37/12 169/37
6,123,153 A * 9/2000 Finnegan ..... A62C 31/02 169/37
6,206,033 B1 * 3/2001 Chang ..... F16K 35/10 137/377
6,347,669 B1 * 2/2002 Sundholm ..... A62C 31/05 169/37
6,487,942 B1 * 12/2002 Carter ..... A62C 31/28 81/367
6,669,111 B2 12/2003 Vinson et al.
6,796,013 B2 * 9/2004 Melker ..... B25B 13/48 29/240
6,957,477 B1 * 10/2005 Neiman ..... B25B 27/14 29/278
7,055,614 B1 * 6/2006 Ide ..... A62C 37/14 169/37
7,185,567 B2 * 3/2007 Ide ..... B25B 13/50 81/124.2
7,273,189 B2 9/2007 Ide et al.
D570,955 S * 6/2008 Franson ..... D23/213
7,540,330 B2 6/2009 Orr et al.
D611,570 S * 3/2010 Yang ..... D23/214
7,757,967 B1 * 7/2010 Yang ..... A62C 37/08 169/37
7,900,852 B2 3/2011 Feenstra
D673,825 S * 1/2013 Koiwa ..... D8/14
8,469,111 B2 6/2013 Orr et al.
8,662,190 B2 * 3/2014 Watson ..... A62C 31/02 169/37
D706,619 S * 6/2014 Oldham ..... D9/414
8,905,151 B2 12/2014 Silva, Jr. et al.
8,910,723 B2 12/2014 Orr et al.
8,936,206 B1 * 1/2015 Wright ..... B05B 15/60 239/288.5
9,027,660 B2 5/2015 Oldham
D768,816 S * 10/2016 Pogliari ..... D23/214
9,630,039 B2 * 4/2017 Koiwa ..... A62C 35/68
D799,924 S * 10/2017 Koiwa ..... D8/29
D868,574 S * 12/2019 Pittman ..... D8/396
2003/0173094 A1 * 9/2003 Vinson ..... A62C 31/28 169/37
2004/0134670 A1 * 7/2004 Orr ..... A62C 31/02 169/37
2005/0035022 A1 * 2/2005 Ide ..... B65D 61/00 206/528
2005/0103888 A1 * 5/2005 Corbett ..... B05B 15/16 239/276
2006/0219817 A1 * 10/2006 Franson ..... A62C 37/08 239/502
2007/0256844 A1 * 11/2007 Blasing ..... A62C 35/68 169/51
2008/0060823 A1 * 3/2008 Ma ..... A62C 35/68 169/37
2010/0059235 A1 * 3/2010 Feenstra ..... A62C 37/12 169/42
2010/0132962 A1 * 6/2010 Silva, Jr. ..... A62C 35/68 169/37
2012/0255629 A1 * 10/2012 Goss ..... A62C 35/68 137/377
2012/0286067 A1 11/2012 Orr et al.
2013/0334809 A1 * 12/2013 Cole, Jr. ..... E03B 7/09 285/13
2014/0096982 A1 * 4/2014 Oldham ..... A62C 37/08 169/37
2015/0075334 A1 * 3/2015 Watson ..... B25B 13/481 81/186
2015/0297927 A1 * 10/2015 Pipe ..... A62C 35/68 169/37
2016/0023029 A1 * 1/2016 Almeida ..... A62C 37/09 169/37
2016/0030785 A1 * 2/2016 Ringer ..... A62C 37/09 169/41
2016/0030787 A1 * 2/2016 De Vries ..... A62C 37/12 169/46
2016/0221018 A1 * 8/2016 Oh ..... A62C 35/68
2017/0028236 A1 * 2/2017 Macomber ..... A62C 35/68
2017/0326393 A1 * 11/2017 Oldham ..... A62C 35/68
2019/0143163 A1 * 5/2019 Schnell ..... A62C 37/11 169/37
2019/0175968 A1 * 6/2019 Pressnell ..... A62C 35/68

FOREIGN PATENT DOCUMENTS

KR 2010 0030149 A 3/2010
TW 201347806 A 12/2013
WO WO 2017/190761 11/2017
WO WO 2017/196596 11/2017

OTHER PUBLICATIONS

International Searching Authority, Written Opinion in International Appln. No. PCT/US2017/030747, dated Aug. 7, 2017, 5 pages.
Australian Patent Office, Australian Patent Application No. 2017263225, Examination Report No. 1 dated Dec. 6, 2018, 5 pages.
Australian Patent Office, Australian Patent Application No. 2017263225, Examination Report No, 2 dated Apr. 26, 2019, 3 pages.
Australian Patent Office, Australian Patent Application No. 2017263225, Examination Report No. 3 dated Aug. 16, 2019, 5 pages.
Canadian Patent Office, Canadian Patent Application No. 3,019,002, Office Action dated Jul. 30, 2019, 5 pages.
Chinese Patent Application No. 201780027895.X, First Office Action and English translation, dated Apr. 7, 2020, 18 pages.
European Patent Application No. 17796579.5, Extended European Search Report dated Feb. 27, 2020; 7 pages.
Korean Patent Office, Korean Patent Application No. 10-2018-7029997, Office Action and English translation, dated Jan. 21, 2020, 12 pages.

* cited by examiner

PUSH ON/PULL OFF PROTECTIVE CAP FOR FIRE PROTECTION SPRINKLERS

CROSS-REFERENCE TO RELATED APPLICATIONS

This application claims the benefit of U.S. Provisional Application No. 62/334,186, filed on May 10, 2016.

FIELD

The present disclosure relates to a protective cap for fire protection sprinklers that can be pushed on and pulled off.

BACKGROUND AND SUMMARY

This section provides background information related to the present disclosure which is not necessarily prior art.

The present disclosure is directed to a protective cover or shipping cap for a fire protection sprinkler. The cover is adapted to releasably engage the sprinkler so that the cover will protect the trigger mechanism during normal shipping and handling of the sprinkler and is easy to install and remove from the sprinkler.

The protective cover for a fire protection sprinkler includes a pair of sidewalls and an orthogonal wall structure connected to an upper edge of each of the pair of sidewalls. The orthogonal wall structure including a slot therein that opens along an edge of the orthogonal wall structure in alignment with an opening between the pair of sidewalls. The slot including a pair of side edges including a pair of opposing arcuate regions adapted to engage a deflector mounting boss of a fire protection sprinkler. An arcuate sidewall extends from the orthogonal wall structure and an upper wall extending inward from an upper edge of the arcuate sidewall and opposing the orthogonal wall structure to define a cavity that is adapted for receiving a deflector of a fire protection sprinkler.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
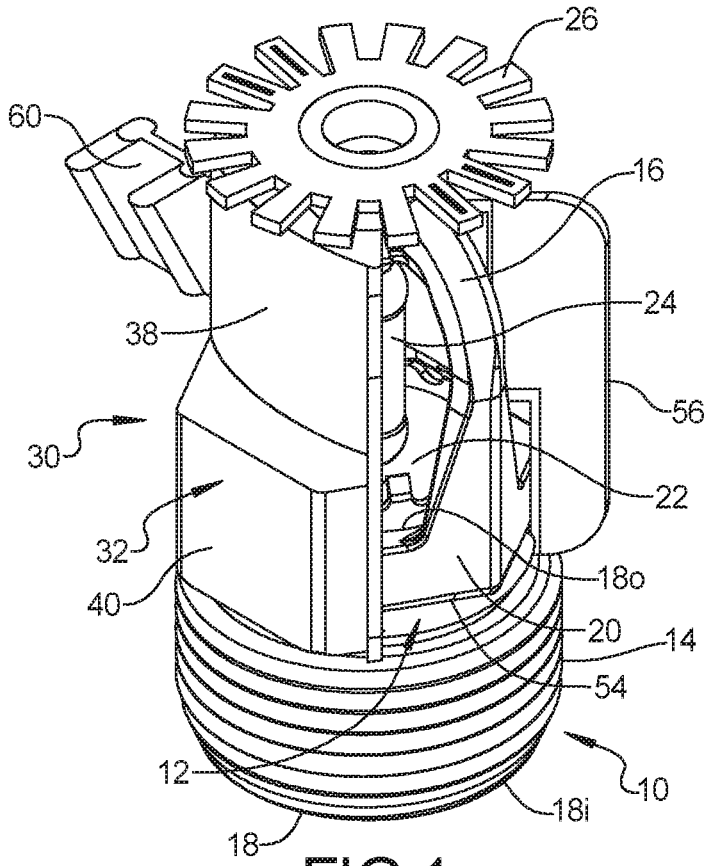
FIG. 1 is a perspective view of the a fire protection sprinkler and protective cap according to the principles of the present disclosure.
Figure 2:
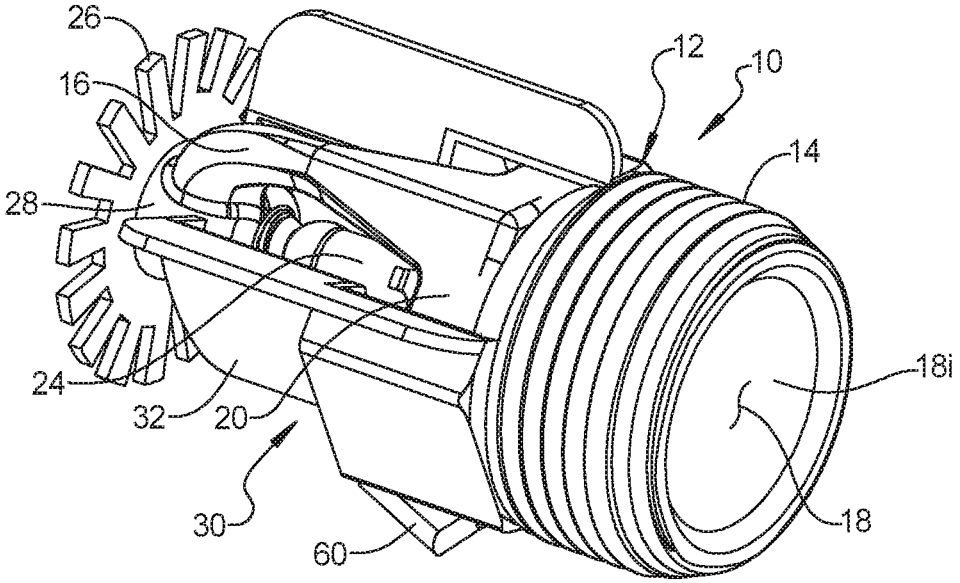
FIG. 2 is a perspective view from a different angle of the fire protection sprinkler and protective cap shown in FIG. 1.
Figure 3:
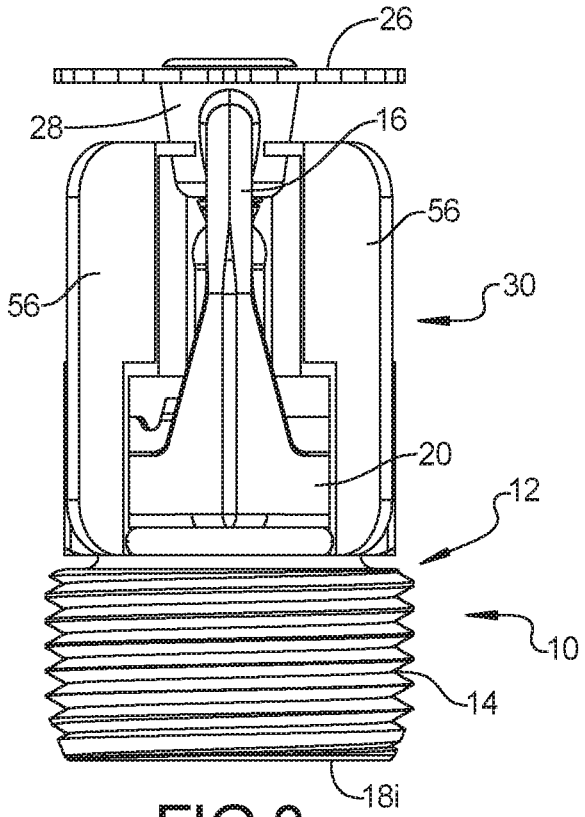
FIG. 3 is a side plan view of the fire protection sprinkler and protective cap shown in FIG. 1.
Figure 4:
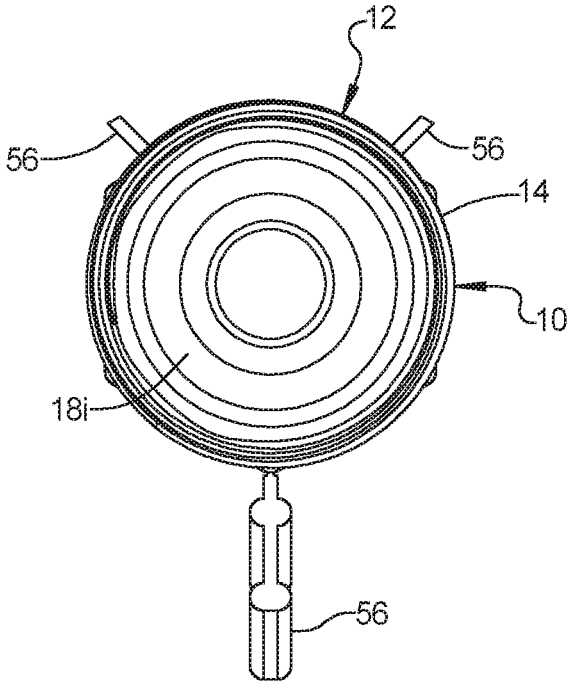
FIG. 4 is a bottom plan view of the fire protection sprinkler and protective cap shown in FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a protective cap 30 is provided for a fire protection sprinkler 10 having a metal sprinkler body 12 including a threaded base 14 that is adapted to be connected to a water supply and includes a pair of frame arms 16. A fluid passage 18 extends through the sprinkler body 12 and includes an inlet end 18*i* and an outlet end 18*o*. The sprinkler body 12 can include a hex-shaped tool engagement portion 20. A closure device 22 is generally disposed in the outlet end 18*o* of the fluid passage 18 and is supported by a heat responsive trigger mechanism 24. The heat responsive trigger mechanism 24 can be in the form of a glass bulb or a fusible linkage. A deflector 26 can be mounted to a boss portion 28 disposed at an end of the frame arms 16.

Figure 5:
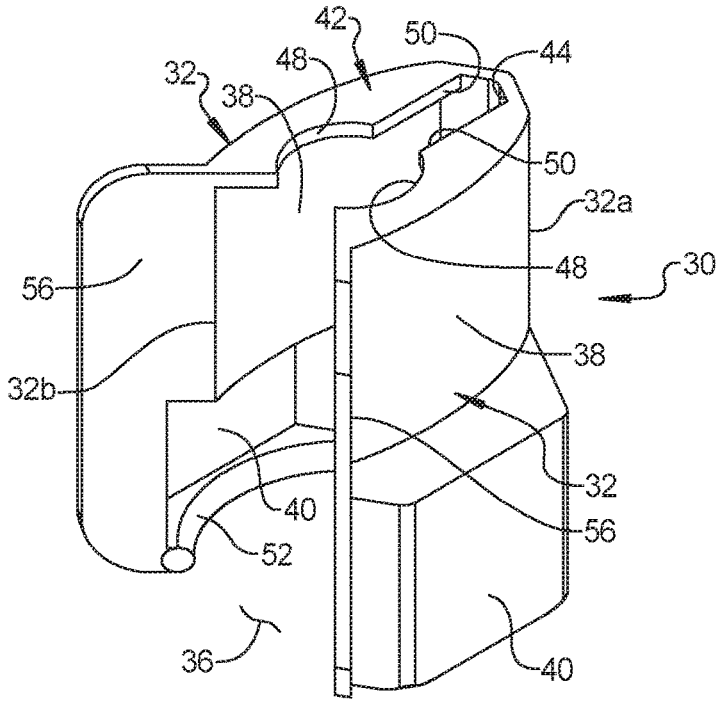
FIG. 5 is a perspective view of the protective cap according to the principles of the present disclosure without a pull handle.
Figure 6:
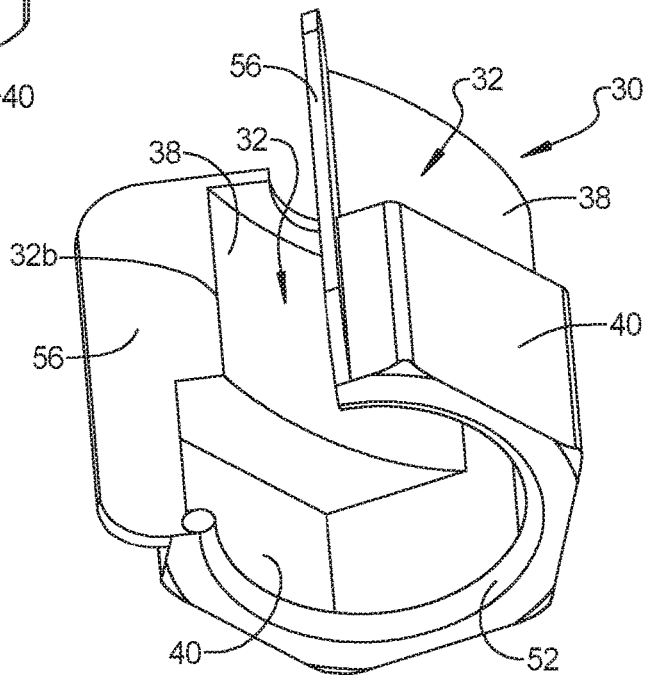
FIG. 6 is a perspective view from a different angle of the protective cap shown in the FIG. 5.
Figure 7:
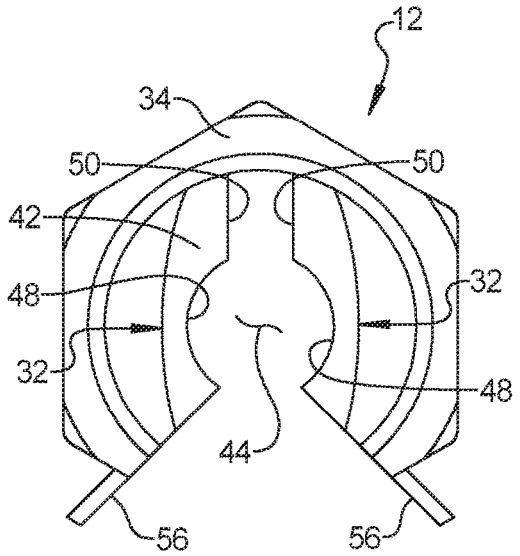
FIG. 7 is a bottom plan view of the protective cap shown in FIG. 5.
Figure 8:
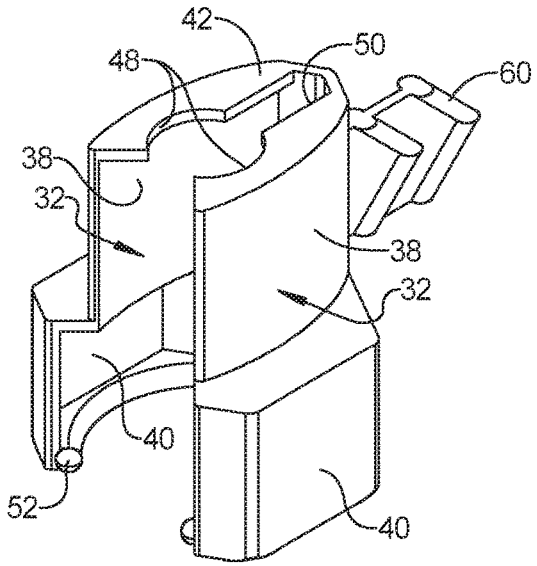
FIG. 8 is a perspective view of the protective cap according to the principles of the present disclosure without the beveled guide walls.
Figure 9:
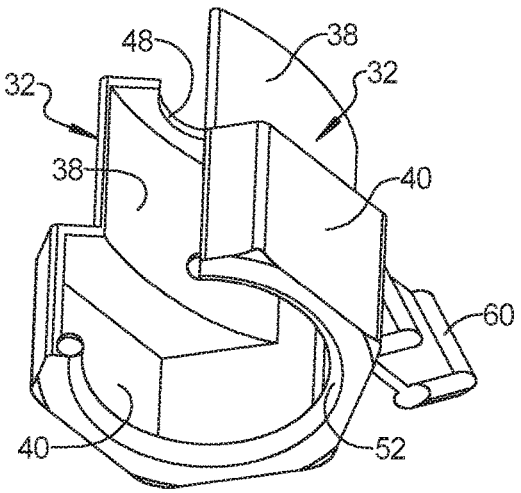
FIG. 9 is a perspective view from a different angle of the protective cap shown in FIG. 8.
Figure 10:
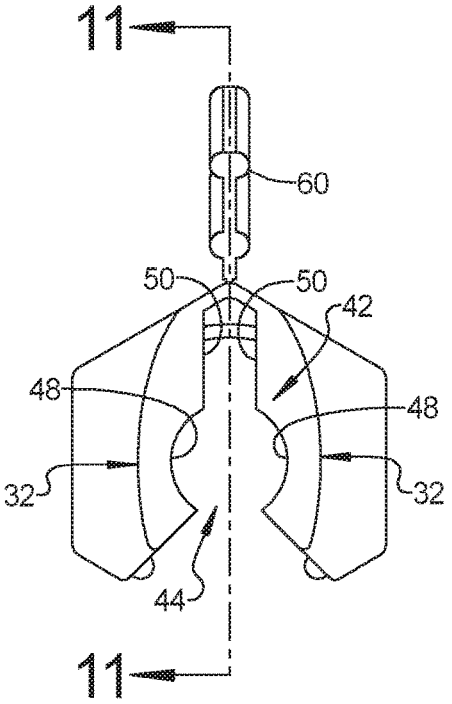
FIG. 10 is a top plan view of the protective cap shown in FIG. 8.
Figure 11:
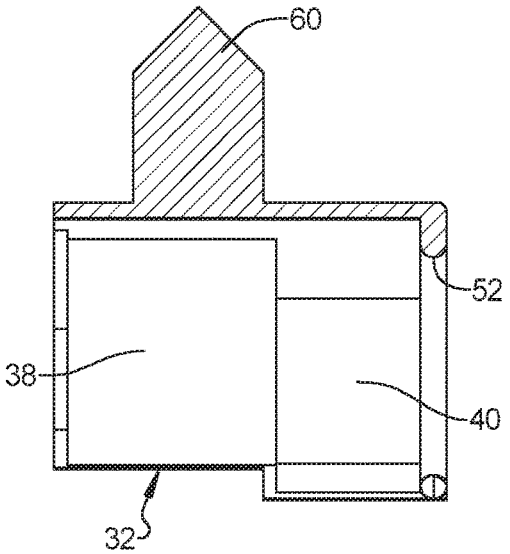
FIG. 11 is a cross-sectional view taken along line 11-11 of FIG. 10.

As best shown in FIGS. 5-7, the protective cap 30 can be made from a single piece of plastic and can include a pair of opposing sidewalls 32 that are connected together along one side edge 32*a* by an connecting wall 34 and that combine to define a side opening 36 along a second side edge 32*b*. Each of the sidewalls 32 can include a first portion 38 that shields the heat responsive trigger mechanism 24 and a second portion 40 that can include a hex-shaped configuration for receiving the hex-shaped tool engagement portion 20 of the fire protection sprinkler 10. The first portion 38 of the sidewalls 32 can be arcuate, as shown, or flat. An end wall portion 42 can extend generally orthogonally between a distal end of the first portions 38 of the sidewalls 32 and can include an inwardly extending slot 44 extending from the side opening 36. The inwardly extending slot 44 can include a pair of side walls that each define a a semi-circular region 48 that are adapted to engage the boss 28 of the frame arms 16 and a parallel sidewall region 50 that extend from the semi-circular regions 48 at a closed end of the slot 44. The parallel sidewall region 50 of the slot 44 are provided for receiving the frame arms 16 therein.

A bottom portion of the sidewalls 32 and the connecting wall 34 can be provided with a semi-annular rib 52 that is adapted to be snap fit within an annular recess 54 between the threaded base 14 and the tool engagement portion 20 of the sprinkler body 12. The sidewalls 32 can also be provided with beveled guide walls 56 extending along the side opening 36 that facilitate spreading of the sidewalls 32 when the protective cap 30 is pushed onto the fire protection sprinkler 10. It is noted that FIGS. 8-11 show the protective cap 30 without the beveled guide walls 56.

FIGS. 1-4 and 8-11 also show the protective cap 30 with an optional pull handle 60 that can be connected to the connecting wall 34 to facilitate removal of the protective cap 30 from the fire protection sprinkler 10. The pull handle 60 is not shown in the optional embodiment of FIGS. 5-7.

The protective cap 30 of the present disclosure is designed to be pushed onto the fire protection sprinkler 10 from one side while the sidewalls spread 32 apart so that the semi-annular rib 52 at the bottom portion of the sidewalls 32 and the semi-circular regions 48 of the inwardly extending slot 44 snap-fit engage with the annular recess 54 of the sprinkler body 12 and the boss 28, respectively. The beveled guide walls 56 serve as a wedge feature to assist in spreading the sidewalls 32 apart while the protective cap 30 is being pushed onto the fire protection sprinkler 10 in a lateral direction that is parallel to a plane of the frame arms 16. In addition, the handle 60 can be utilized to pull the protective cap 30 off of the fire protection sprinkler 10 in an opposite lateral direction that is parallel to the plane of the frame arms 16. If the pull handle 60 and/or the beveled guide walls 58 are omitted, the side edge 32*b* of the sidewalls 32 can be spread by the users hand or can simply be pushed against the sprinkler 10 to cause the sidewalls 32 to spread. In addition, during removal of the protective cap without the pull handle 60, the beveled guide walls 58 or sidewalls 32 can be pushed or pulled in the removal direction to cause the sidewalls 32 to spread and disengage from the sprinkler 10.

It is noted that the fire protection sprinkler 10 can be installed onto a fluid supply line while the protective cap 30 is disposed on the sprinkler 10 by engaging the hex-shaped second portion 40 of the sidewalls 32 with a tool. The protective cap 30 can then be easily removed by pulling laterally on the handle 60 until the protective cap 30 is released from the fire protection sprinkler 10. It should be noted that the shape of the hex-shaped second portion 40 of the sidewalls 32 can be modified, although the aforementioned assembly feature may be eliminated.

Figure 12:
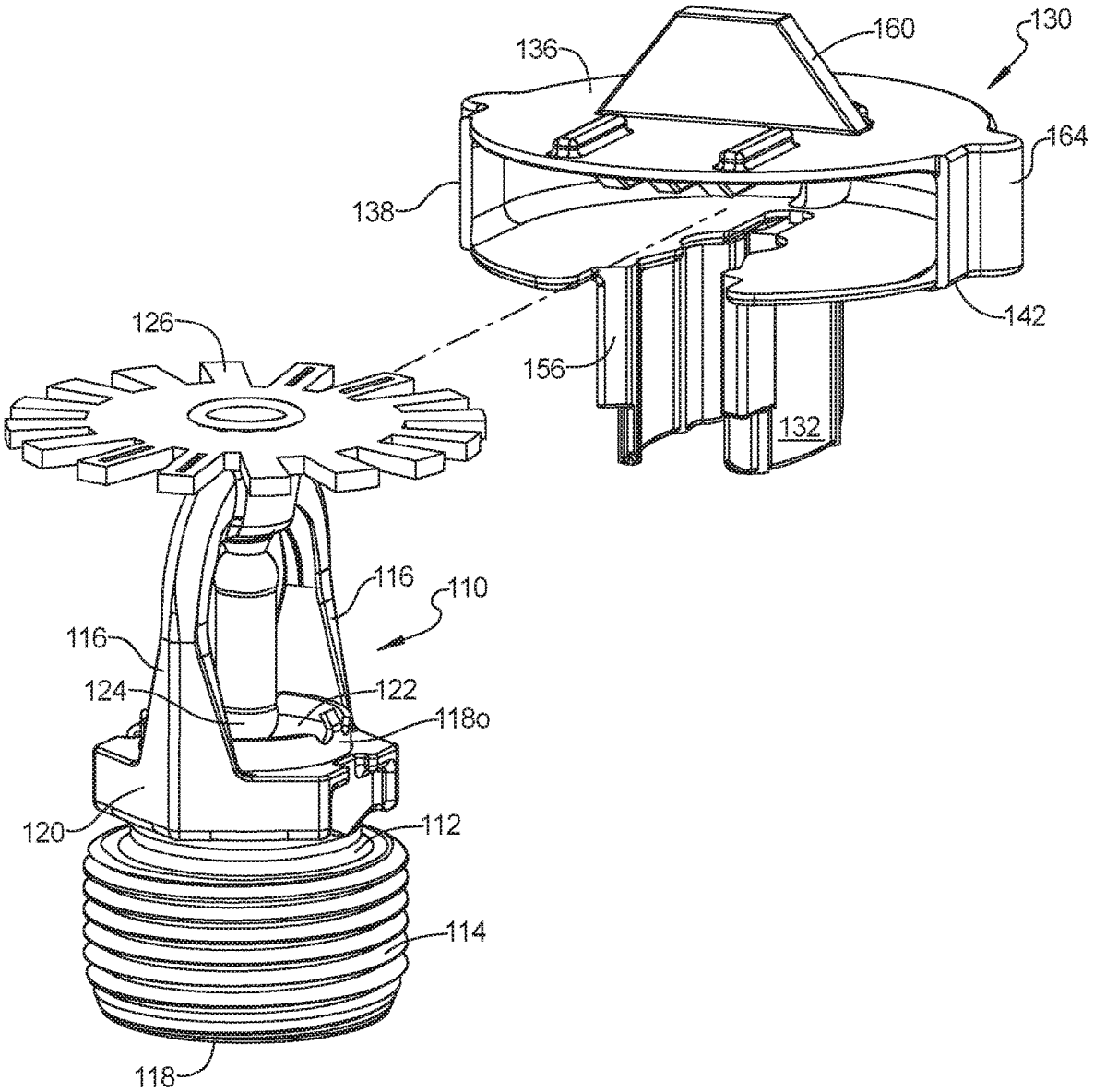
FIG. 12 is a side perspective view of a fire protection sprinkler and alternative protective cap according to the principles of the present disclosure.
Figure 13:
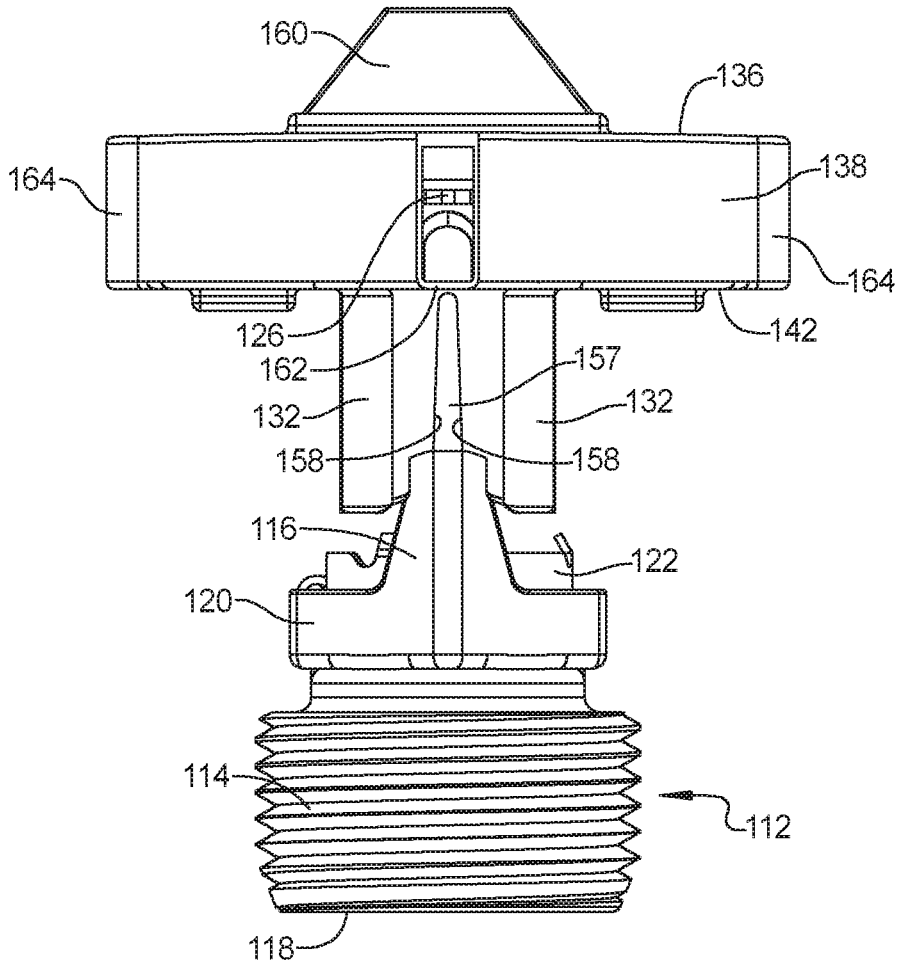
FIG. 13 is a back view of the fire protection sprinkler and protective cap shown in FIG. 12.
Figure 14:
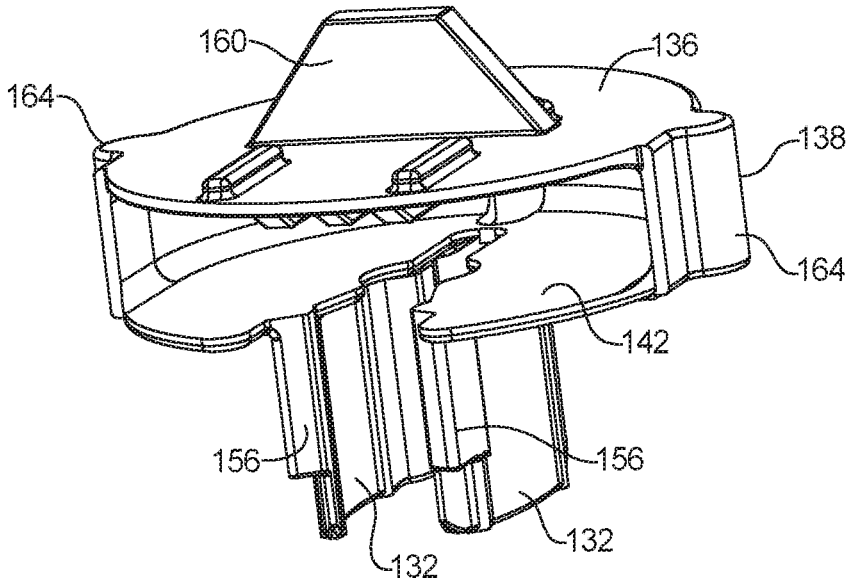
FIG. 14 is a front perspective view of the protective cap shown in FIG. 12.
Figure 15:
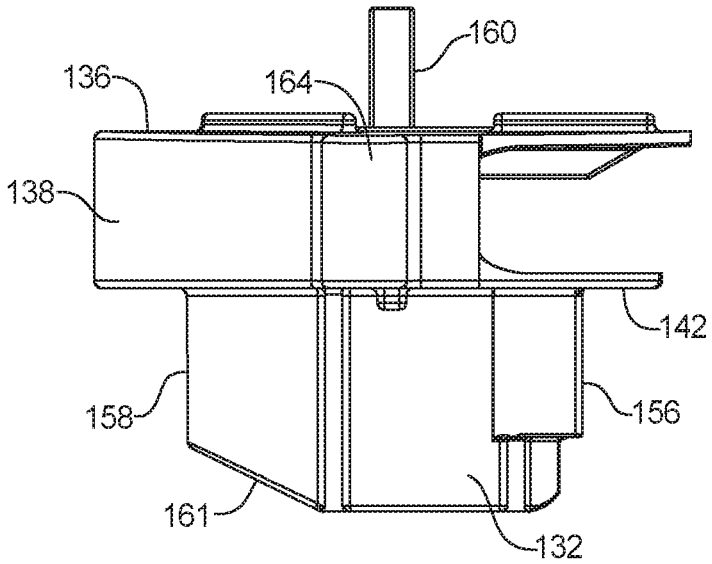
FIG. 15 is a side plan view of the protective cap shown in FIG. 12.
Figure 16:
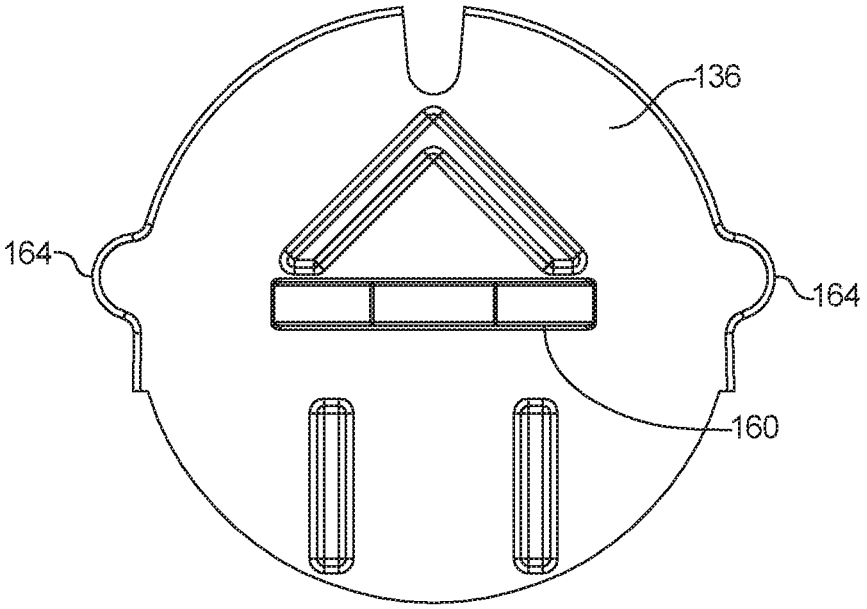
FIG. 16 is a top plan view of the protective cap shown in FIG. 12.
Figure 17:
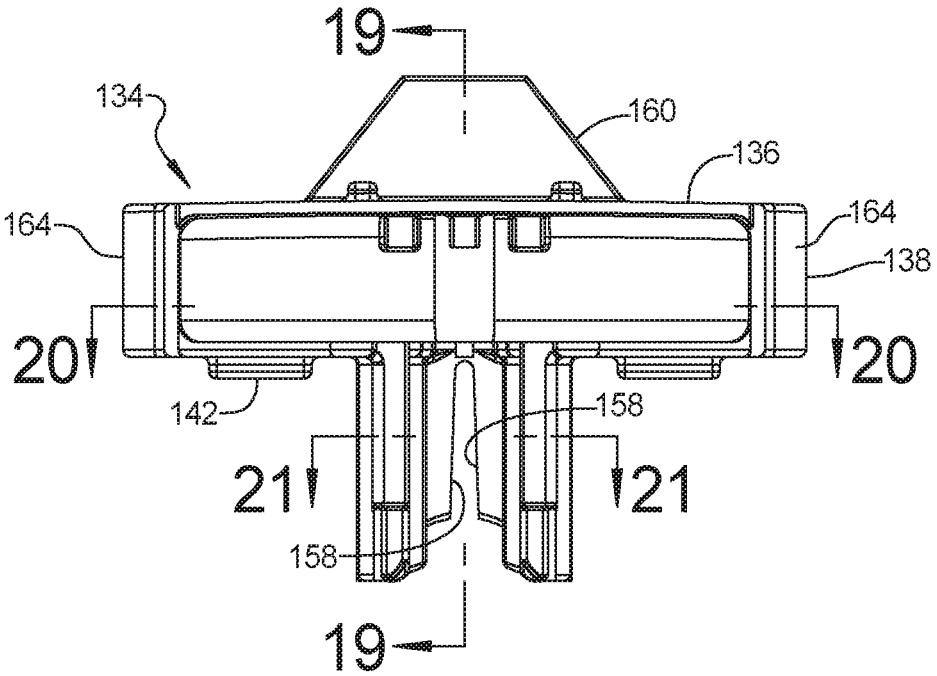
FIG. 17 is a front plan view of the protective cap shown in the FIG. 12.
Figure 18:
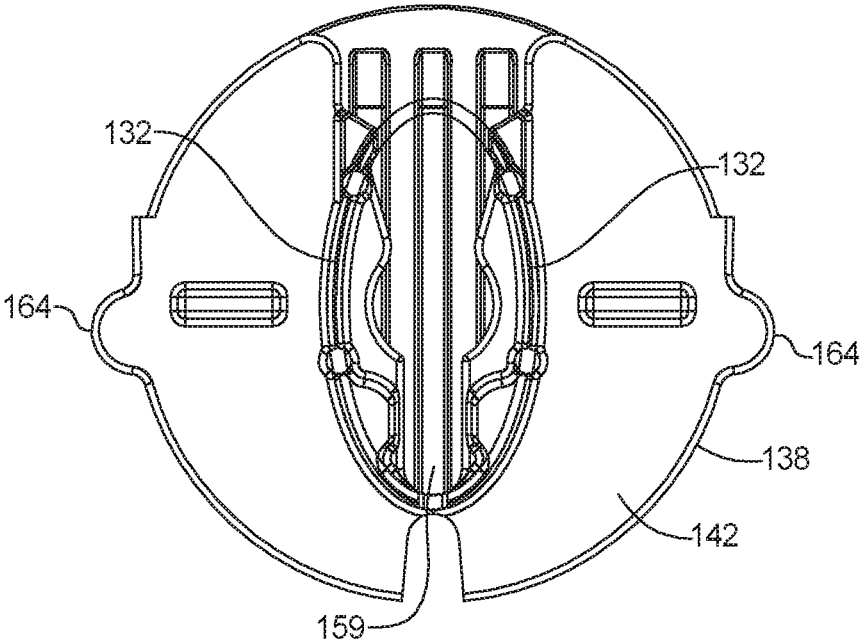
FIG. 18 is a bottom plan view of the protective cap shown in FIG. 12.
Figure 19:
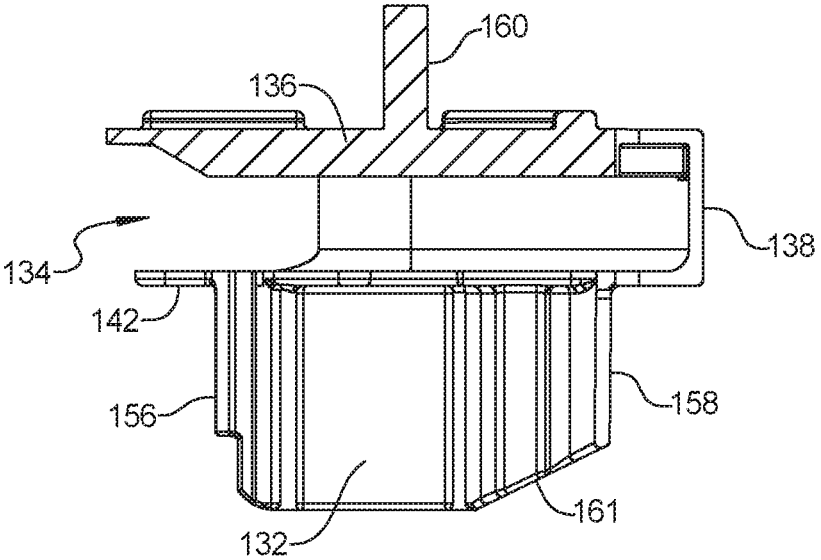
FIG. 19 is a cross-sectional view taken along line 19-19 of FIG. 17.
Figure 20:
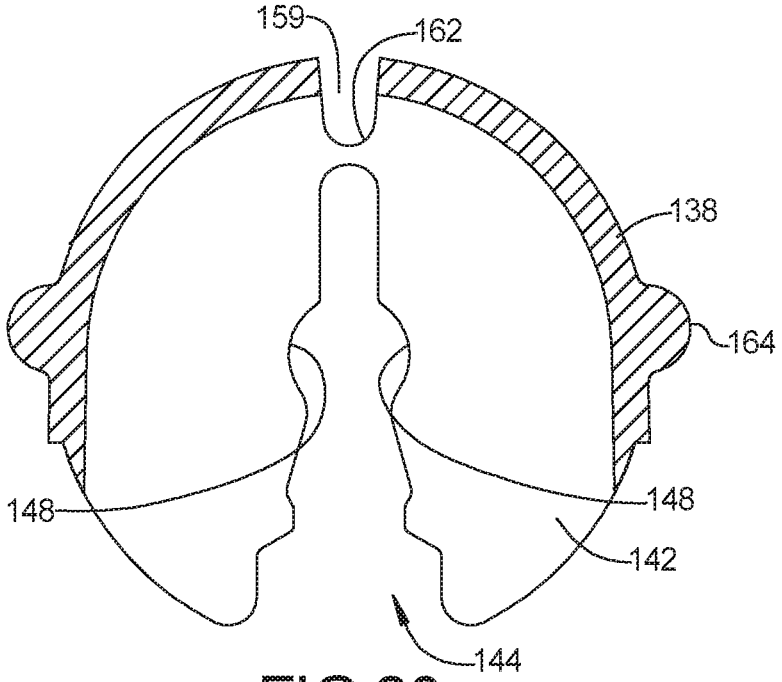
FIG. 20 is a cross section view taken along line 20-20 of FIG. 17.

With reference to FIGS. 12 and 13, an alternative protective cap 130 is provided for a fire protection sprinkler 110 having a metal sprinkler body 112 including a threaded base 114 that is adapted to be connected to a water supply and includes a pair of frame arms 116. A fluid passage extends through the sprinkler body 112 and includes an inlet end 118*i* and an outlet end 118*o*. The sprinkler body 112 can include a hex-shaped tool engagement portion 120. A closure device 122 is generally disposed in the outlet end 118*o* of the fluid passage 118 and is supported by a heat responsive trigger mechanism 124. The heat responsive trigger mechanism 124 can be in the form of a glass bulb or a fusible linkage. A deflector 126 (partially shown) can be mounted to a boss portion (not shown) disposed at an end of the frame arms 116.

As best shown in FIGS. 12-21, the protective cap 130 can be made from a single piece of plastic and can include a pair of opposing sidewalls 132 that are connected along an upper edge 132 to a deflector receiving portion 134. In an installed position, as shown in FIGS. 12 and 13, each of the sidewalls 132 shields the heat responsive trigger mechanism 124. The sidewalls 132 can be arcuate, as shown, or flat. The deflector receiving portion 134 includes an upper wall 136, a partially cylindrical sidewall 138 and a lower wall 142 that can extend generally orthogonally between a distal end of the pair of sidewalls 132. As shown in FIGS. 14 and 18-20 the lower wall 142 can include an inwardly extending slot 144 extending from a side opening between the sidewalls 132. The inwardly extending slot 144 can include a pair of side walls that each define a semi-circular region 148 that are adapted to engage the boss 128 of the frame arms 116 and a parallel sidewall region 150 that extend from the semi-circular regions 148 at a closed end of the slot 144. The parallel sidewall region 150 of the slot 144 are provided for receiving the frame arms 16 therein.

Figure 21:
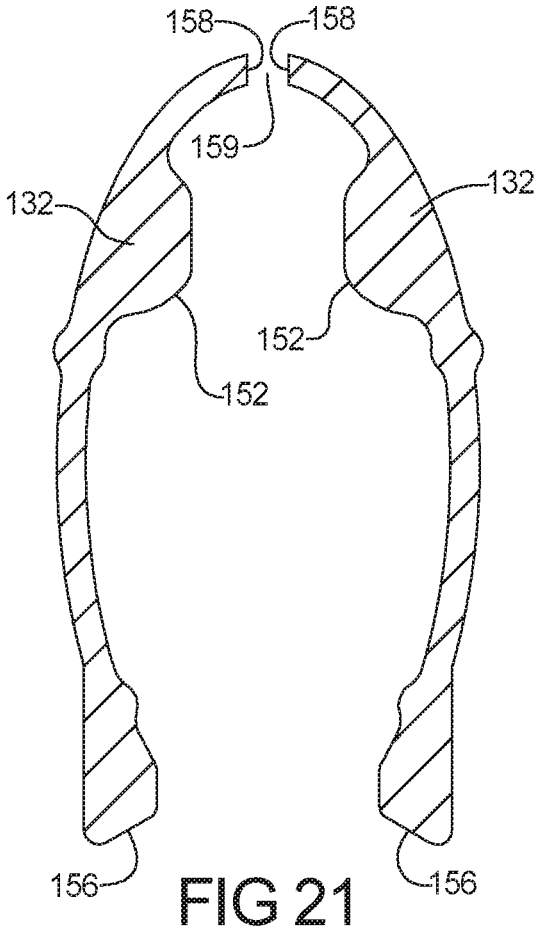
FIG. 21 is a cross sectional view taken along line 21-21 of FIG. 17.

As shown in FIG. 21, the sidewalls 132 each include a rounded protruding portion 152 extending inward therefrom. The rounded protruding portions 152 are designed to engage one of the frame arms 116 to lockingly engage the protective cap on the frame arm 116. The sidewalls 132 can also be provided with beveled guide walls 156 extending along the side opening that facilitate spreading of the sidewalls 132 when the protective cap 130 is pushed onto the fire protection sprinkler 110.

FIGS. 1-4 and 8-11 also show the protective cap 130 with an optional grip 160 that can extend from the upper wall 136 of the deflector receiving portion 134 to facilitate removal of the protective cap 130 from the fire protection sprinkler 110. The pair of sidewalls 132 each include the forward beveled edge 156 along the opening between the pair of sidewalls 132 and the pair of sidewalls 132 each include a rear edge 158 with a gap 159 defined between the rear edges 158 of the pair of sidewalls 132. The pair of sidewalls 132 each include a sloped bottom edge 161 adjacent the rear edge 158. The lower wall 142 of the deflector receiving portion 134 includes a web 162 between the slot 144 and the gap 159 defined between the rear edges 158 of the pair of sidewalls 132.

The protective cap 130 of the present disclosure is designed to be pushed onto the fire protection sprinkler 110 from one side while the sidewalls 132 spread apart so that the rounded protruding portions 152 on the inner side of the sidewalls 132 engage the frame arm 116 and the semi-circular regions 148 of the inwardly extending slot 144 snap-fit engage with the boss 128, respectively. The beveled guide walls 156 serve as a wedge feature to assist in spreading the sidewalls 132 apart while the protective cap 130 is being pushed onto the fire protection sprinkler 110 in a lateral direction that is parallel to a plane of the frame arms 116. In addition, the grip 160 can be utilized to pull the protective cap 130 off of the fire protection sprinkler 110 in an opposite lateral direction that is parallel to the plane of the frame arms 116. Additional side grip protrusions 164 can extend from the partially cylindrical sidewall 138 of the deflector receiving portion 134 for providing an additional grip for inserting and removing the protective cap 130.

It is noted that the fire protection sprinkler 110 can be installed onto a fluid supply line while the protective cap 130 is disposed on the sprinkler 110. The protective cap 130 can then be easily removed by pulling laterally on the grip 160 until the protective cap 130 is released from the fire protection sprinkler 110.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A protective cover for a fire protection sprinkler comprising:

a pair of sidewalls;

an orthogonal wall structure connected to an upper edge of each of the pair of sidewalls, said orthogonal wall structure including a slot therein that opens along an edge of the orthogonal wall structure in alignment with a side opening between the pair of sidewalls, the slot including a pair of side edges including a pair of opposing arcuate regions that engage a deflector mounting boss disposed between a deflector and an end of a pair of frame arms of a fire protection sprinkler;

an arcuate sidewall extending from said orthogonal wall structure: and an upper wall extending inward from an upper edge of the arcuate sidewalk the upper wall opposing and overlapping the orthogonal wall structure, wherein the orthogonal wall structure, the arcuate sidewalk and the upper wall defining a cavity that receives the deflector of the fire protection sprinkler.

2. The protective cover according to claim 1, wherein the pair of sidewalls each include opposing protruding portions on an inside thereof.

3. The protective cover according to claim 1, wherein said pair of sidewalls each include a beveled guide wall along the side opening between the pair of sidewalls.

4. The protective cover according to claim 1, wherein the pair of sidewalls each include a forward edge along the side opening between the pair of sidewalls and the pair of sidewalls each include a rear edge with a gap defined between the rear edges of the pair of sidewalls.

5. The protective cover according to claim 4, wherein the orthogonal wall structure includes a web between the slot and the gap defined between the rear edges of the pair of sidewalls.

6. The protective cover according to claim 4, wherein the pair of sidewalls each include a sloped bottom edge adjacent the rear edge.

7. The protective cover according to claim 1, further comprising a grip extending from the upper wall.

8. A shipping cap for a fire protection sprinkler, comprising:

a pair of sidewalls;

a deflector receiving portion including an orthogonal wall structure connected to an upper edge of each of the pair of sidewalls, a sidewall extending from said orthogonal wall structure and an upper wall extending inward from an upper edge of the sidewall and opposing the orthogonal wall structure, the orthogonal wall structure, the sidewall and the upper wall defining a deflector cavity that laterally receives a deflector of a fire protection sprinkler, said orthogonal wall structure including a slot therein that engages a deflector mounting boss disposed between the deflector and an end of a pair of frame arms of the fire protection sprinkler and that opens along an edge of the orthogonal wall structure in alignment with a side opening between the pair of sidewalls.

9. The shipping cap according to claim 8, wherein the pair of sidewalls each include opposing protruding portions on an inside thereof.

10. The shipping cap according to claim 8, wherein said pair of sidewalls each include a beveled guide wall along the side opening between the pair of sidewalls.

11. The shipping cap according to claim 8, wherein the pair of sidewalls each include a forward edge along the side opening between the pair of sidewalls and the pair of sidewalls each include a rear edge with a gap defined between the rear edges of the pair of sidewalls.

12. The shipping cap according to claim 11, wherein the orthogonal wall structure includes a web between the slot and the gap defined between the rear edges of the pair of sidewalls.

13. The shipping cap according to claim 11, wherein the pair of sidewalls each include a sloped bottom edge adjacent the rear edge.

14. The shipping cap according to claim 8, wherein the slot includes a pair of side edges including a pair of opposing arcuate regions that engage the deflector mounting boss of the fire protection sprinkler.

15. The shipping cap according to claim 8, further comprising a grip extending from the upper wall.

16. The shipping cap according to claim 8, wherein the sidewall comprises a partially arcuate sidewall.

* * * * *